US007503406B2

(12) United States Patent
Seaton et al.

(10) Patent No.: US 7,503,406 B2
(45) Date of Patent: Mar. 17, 2009

(54) METHOD FOR PROCESSING DRILLING CUTTINGS IN AN OIL RECOVERY OPERATION

(75) Inventors: Simon D. Seaton, The Woodlands, TX (US); Ronald G. Morris, Montrose (GB); Per-Bjarte Tanche-Larsson, Sandnes (NO)

(73) Assignee: Halliburton Energy Services, Inc., Duncan, OK (US)

( * ) Notice: Subject to any disclaimer, the term of this patent is extended or adjusted under 35 U.S.C. 154(b) by 54 days.

(21) Appl. No.: 11/341,216

(22) Filed: Jan. 27, 2006

(65) Prior Publication Data

US 2007/0175667 A1 Aug. 2, 2007

(51) Int. Cl.
*E21B 21/06* (2006.01)
*E21B 21/01* (2006.01)

(52) U.S. Cl. ..... 175/66; 175/207; 166/75.12

(58) Field of Classification Search ..... 175/57, 175/66, 207; 166/75.12
See application file for complete search history.

(56) References Cited

U.S. PATENT DOCUMENTS

| | | | | |
|---|---|---|---|---|
| 2,152,665 | A | 4/1939 | Rosenthal | |
| 4,040,866 | A * | 8/1977 | Mondshine | 134/26 |
| 4,434,028 | A | 2/1984 | Eppig et al. | |
| 4,451,377 | A | 5/1984 | Luxemburg | |
| 4,599,117 | A | 7/1986 | Luxemburg | |
| 4,645,608 | A | 2/1987 | Rayborn | |
| D296,027 | S * | 5/1988 | Dietzen | D34/39 |
| 4,836,302 | A | 6/1989 | Heilhecker et al. | |
| 5,004,051 | A * | 4/1991 | Rosendahl et al. | 166/357 |
| 5,005,655 | A | 4/1991 | Stokke et al. | |
| 5,053,082 | A | 10/1991 | Flanigan et al. | |
| 5,090,498 | A | 2/1992 | Hamill | |
| 5,092,983 | A | 3/1992 | Eppig et al. | |
| 5,156,686 | A * | 10/1992 | Van Slyke | 134/26 |
| 5,199,997 | A | 4/1993 | Stowe | |
| 5,490,531 | A | 2/1996 | Bala | |
| 5,564,509 | A | 10/1996 | Dietzen | |
| 5,971,084 | A * | 10/1999 | Dietzen | 175/66 |
| 6,179,070 | B1 * | 1/2001 | Dietzen | 175/66 |
| 6,453,584 | B1 * | 9/2002 | Buckner | 37/323 |
| 6,796,379 | B1 * | 9/2004 | Martin | 166/356 |
| 7,185,705 | B2 * | 3/2007 | Fontana | 166/356 |
| 7,195,084 | B2 * | 3/2007 | Burnett et al. | 175/66 |
| 2002/0189139 | A1 | 12/2002 | Buckner | |
| 2003/0037922 | A1 * | 2/2003 | Gibson | 166/206 |
| 2004/0112816 | A1 * | 6/2004 | Smith et al. | 210/202 |
| 2005/0236015 | A1 * | 10/2005 | Goel et al. | 134/10 |

OTHER PUBLICATIONS

XP-002426499 "Recovery of Oil From Drilled Cuttings by Liquefied Gas Extraction" by S. Seaton, et al. SPE 92963, Feb. 2005.
Foreign communication related to a counterpart application dated Apr. 3, 2007.

* cited by examiner

*Primary Examiner*—Shane Bomar
(74) *Attorney, Agent, or Firm*—John W. Wustenberg; Conley Rose, P.C.

(57) ABSTRACT

A method for the recovery of oil according to which a well is drilled using a drill bit; drilling fluid is introduced to the drill bit and a mixture of the fluid and cuttings from the well is passed to the ground surface. The mixture is passed into a vessel and the vessel is transported from the ground surface to another area where the fluid is separated from the cuttings in the vessel.

20 Claims, 2 Drawing Sheets

METHOD FOR PROCESSING DRILLING CUTTINGS IN AN OIL RECOVERY OPERATION

BACKGROUND

Technology in connection with the exploration moreover production of hydrocarbon fluids, such as oil and gas, includes a variety of methods of drilling a wellbore into a formation to find and remove hydrocarbon fluids. During these drilling operations, drilling fluid is often pumped down through a drill pipe and into the wellbore through a drill bit, largely for the purposes of cleaning, lubricating, and cooling the drill bit. The drilling fluid mixes with sludge and cuttings (hereinafter referred to as "cuttings"), such as crushed rock and clay, before it is returned to the ground surface.

At the surface, the drilling fluid is typically separated from the cuttings and reused in the drilling process prior to disposal of the cuttings, especially when the drilling fluid includes oils or synthetic oils. However this separation at the rig site may be inefficient with typical rig site solids control equipment such as shale shakers, hydrocyclones and centrifuges, and a significant amount of drilling fluid may remain associated with the cuttings. In certain areas, the levels of oil that remain associated with the cuttings exceeds the levels allowed for discharge overboard or disposal at industrial landfills, and some form of secondary treatment is required.

Since the secondary treatment can not be done at the rig site with conventional equipment, in many cases the cuttings are collected at the rig site and transferred to a vessel such as a container, box, skip, or the like, that is then transported to a secondary drilling waste treatment facility, where the cuttings are emptied from the transport vessel. At this site further separation could be carried out using solvents, detergents, or thermal energy to reduce the oil levels on the cuttings to an acceptable level for disposal. An example of a drill cutting deoiling system is disclosed in United States Patent Application Publication No. 2005/0236015, which is incorporated herein by reference in its entirety. This secondary treatment site may be located within the drilling location or at another area. However, this involves unloading the cuttings and fluid from the transfer vessel either into a storage facility or directly into some kind of treatment vessel or unit. This transfer could require significant manpower and equipment. The transfer vessel is then cleaned and returned to the drilling site and refilled.

It can be appreciated that the large quantities of cuttings involved make it difficult, cumbersome, time-consuming, and expensive to transfer the mixture of fluid and cuttings to a vessel for transport to a treatment facility, then to empty the transfer vessel so it can be cleaned and returned to drilling site, and then to load the cuttings and fluids into the treatment process to reduce the oil content prior to disposal.

The present invention overcomes this problem.

SUMMARY

In one embodiment, the disclosure includes a method comprising drilling a well using a drill bit, introducing drilling fluid to the drill bit, passing a mixture of the fluid and cuttings from the well to a ground surface, passing the mixture into a vessel, transporting the vessel from the ground surface to another area, and separating the fluid from the cuttings in the vessel.

DETAILED DESCRIPTION

Figure 1:
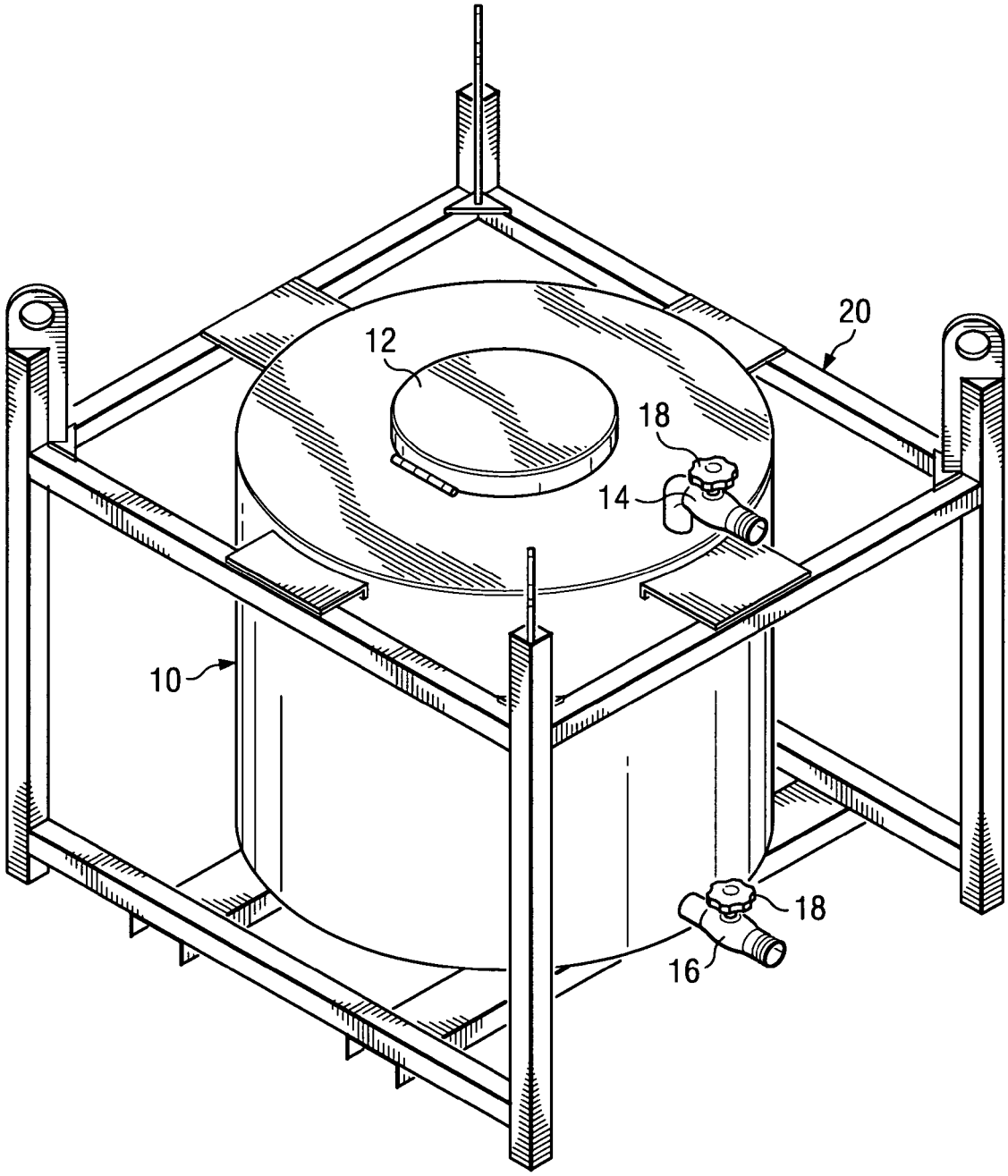
FIG. 1 is a isometric view of a separation and transfer vessel that can be used in the above method.

In FIG. 1 of the drawings, the reference numeral 10 refers, in general, to a collection vessel utilized in the method according to an embodiment of the invention. Preferably, the vessel 10 is in the form of a cylindrical enclosure, having a hatch 12 provided in its upper end, as viewed in the drawing, for receiving a mixture of drilling fluid and cuttings. An inlet pipe 14 is also provided through the upper end of the vessel 10, and a discharge pipe 16 is provided in the lower portion of the cylindrical wall of the vessel 10, for reasons to be described. A control valve 18 is provided on each of the pipes 14 and 16 for controlling the flow of fluid through the pipes 14 and 16. It is understood that the vessel 10 is designed to contain fluids at relatively high pressures to permit certain reactions to occur, as will be described.

The vessel 10 is supported in a rack, or frame, 20, and is attached to the frame 20 in any conventional manner for the purpose of transporting the vessel 10, in a manner to be described.

Figure 2:
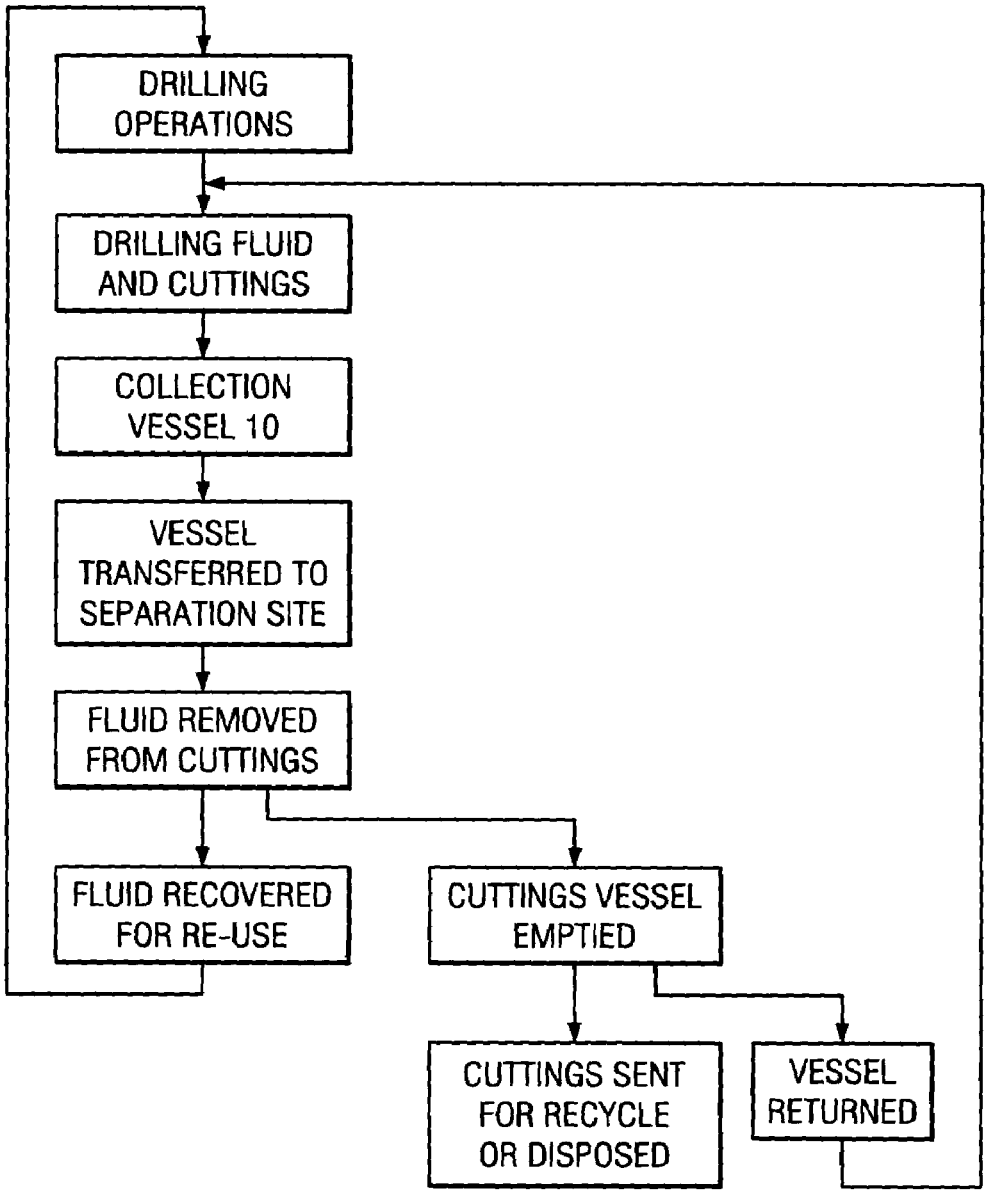
FIG. 2 is a schematic view depicting an exemplary sequence of steps according to an exemplary embodiment of a method of the invention.

FIG. 2 depicts a series of method steps according to an exemplary embodiment utilizing the vessel 10 of FIG. 1. The method relates to the drilling of a wellbore into a formation at a drilling location to find or remove hydrocarbon fluids. As discussed above, during these drilling operations, drilling fluid, usually in the form of oil, or synthetic oil, is pumped down through a drill pipe and into the borehole through a drill bit, largely for the reasons indicated above. When the drilling fluid is returned to the surface, it brings up cuttings with it that must be removed from the fluid.

To this end, and according to a step of the method, the vessel 10, described above, is located at the drilling location near the wellbore and receives the mixture of the drilling fluid and the cuttings. The vessel 10 is then sealed and transferred to a separation site area that may also be at the drilling location and therefore near the wellbore. Alternately, the vessel 10 can be transferred to a site relatively far from the drilling location, in which case the vessel 10 would be transported to the site via a truck or railcar. If an offshore operation is involved, the mixture would be received in the vessel 10 on a platform, and the filled and sealed vessel 10 transferred by boat to the separation site. In any of the above cases the frame 20 facilitates the transfer of the vessel 10 to and from the truck, railcar, or boat using a fork lift, or other similar equipment, that engages the frame 20, in a conventional manner.

At the separation site, the fluid is separated from the cuttings by any of the techniques discussed above. According to one example, liquefied hydrocarbon gas is pumped into the vessel 10 through the inlet pipe 14, where it contacts the cuttings at fluid extraction conditions (including temperature and pressure) sufficient to separate the cuttings from a mixture comprising the gas and soluble oil including at least a portion of the hydrocarbons. It is understood that the vessel 10 can include some internal agitation apparatus (not shown) as needed so that the liquefied gas and the cuttings are thoroughly mixed to help ensure complete extraction of the oil. The mixture of the gas and soluble oil is then discharged from the vessel 10 through the discharge pipe 16. Since this process is conventional, it will not be described in any further detail.

It is also understood that the gas and soluble oil could be separated after being discharged from the vessel 10 in a conventional manner. The separated oil would be collected for re-use as a drilling fluid and the separated gas would be compressed and recycled as a solvent.

Once the gas and soluble oil exit the vessel 10, the hatch 12 of the vessel 10 is opened, and the dry, clean, separated cuttings are discharged so that they can be recycled or disposed of in any conventional manner. The vessel 10 is then transported back to the drilling location in the same manner as discussed above.

It is noted that the separation step using liquefied hydrocarbon gas described above also cleans the interior of the vessel 10. Thus, the vessel 10 can be transported back to the drilling location without the need for any additional cleaning.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A method comprising:

drilling a well using a drill bit;

introducing drilling fluid to the drill bit;

passing a mixture of the fluid and cuttings from the well to a ground surface;

passing the mixture into a vessel;

transporting the vessel from the ground surface to another area; and separating the fluid from the cuttings in the vessel.

2. The method of claim 1 further comprising discharging the separated cuttings from the vessel and transferring the vessel back to the ground surface for further use.

3. The method of claim 1 wherein the ground surface is relatively near the well and the other area is relatively far from the well.

4. The method of claim 1 wherein the ground surface and the other area are relatively near the well.

5. The method of claim 1 wherein the separating step comprises contacting the drill cuttings with a solvent in the vessel at fluid extraction conditions sufficient to produce a mixture comprising drill cuttings and used solvent fluid.

6. The method of claim 1 wherein the fluid is separated from the cuttings at the other area.

7. The method of claim 1 wherein separating the fluid from the cuttings comprises using a detergent to reduce the amount of fluid on the cuttings to an acceptable level for disposal.

8. The method of claim 1 wherein separating the fluid from the cuttings comprises using thermal energy to reduce the amount of fluid on the cuttings to an acceptable level for disposal.

9. A method comprising:

placing a mixture comprising a plurality of drill cuttings and a drilling fluid in a vessel at a drilling location;

transporting the vessel from a drilling location to a separation site;

cleaning the drilling fluid off the drill cuttings in the vessel using a solvent at fluid extraction conditions sufficient to produce a plurality of clean drill cuttings and a spent solvent comprising the drilling fluid; and separating the spent solvent from the clean drill cuttings in the vessel at the separation site.

10. The method of claim 9 wherein cleaning the drilling fluid off the drill cuttings comprises:

adding a as to the vessel, wherein the gas comprises the solvent; and allowing the gas to mix with the drilling fluid, thereby removing the oil-based drilling fluid from the drill cuttings and producing the spent solvent.

11. The method of claim 10 wherein the gas is a liquefied hydrocarbon gas.

12. The method of claim 10 wherein cleaning the drilling fluid off the drill cuttings further comprises: agitating the mixture of gas, drilling fluid, and drill cuttings.

13. The method of claim 10 wherein the gas extracts the drilling fluid from the drill cuttings.

14. The method of claim 10 wherein the gas cleans the interior of the vessel.

15. The method of claim 9 wherein subsequent to cleaning the drilling fluid off the drill cuttings, the drill cuttings are substantially free of drilling fluid.

16. The method of claim 9 further comprising: removing the drill cuttings from the vessel.

17. The method of claim 9 further comprising pre-treating the mixture using a shale shaker, a hydrocyclone, a centrifuge, or combinations thereof prior to placing the mixture in the vessel, wherein the pre-treating removes some of the drilling fluid from the mixture.

18. The method of claim 9 wherein the drilling location is an offshore platform.

19. The method of claim 9 wherein separating the spent solvent from the clean drill cuttings comprises removing the spent solvent and drilling fluid from the vessel while retaining the clean drill cuttings in the vessel.

20. A method comprising:

pre-treating a mixture comprising a plurality of drill cuttings and a drilling fluid using a shale shaker, a hydrocyclone, a centrifuge, or combinations thereof, wherein the pre-treating removes some of the drilling fluid from the mixture;

subsequently placing the mixture in a vessel at a drilling location;

subsequently transporting the vessel from the drilling location to a separation site; and subsequently cleaning the drilling fluid off the drill cuttings at the separation site without removing the drill cuttings from the vessel, thereby producing a plurality of clean drill cuttings and a spent solvent comprising the drilling fluid; and subsequently separating the spent solvent from the clean drill cuttings in the vessel at the separation site, wherein subsequent to separating the drilling fluid from the drill cuttings without removing the drill cuttings from the vessel, the drill cuttings are substantially free of drilling fluid.

* * * * *